US005695382A

United States Patent [19]

Lin

[11] Patent Number: 5,695,382

[45] Date of Patent: Dec. 9, 1997

[54] TRANSMISSION MECHANISM OF A MOTION TOY DOLL

[76] Inventor: Chung-Mei Lin, 4F, No. 9, Lane 96, Section 2, Shi-Yuan Road, Taipei, Taiwan

[21] Appl. No.: 747,673

[22] Filed: Nov. 12, 1996

[51] Int. Cl.[6] ..... A63H 30/00; G09F 19/08

[52] U.S. Cl. ..... 446/354; 40/418

[58] Field of Search ..... 446/354, 355; 40/418, 419, 420, 415

[56] References Cited

U.S. PATENT DOCUMENTS

| | | | |
|---|---|---|---|
| 2,927,467 | 3/1960 | Sala | 74/42 |
| 3,583,098 | 6/1971 | Bear et al. | 446/254 |
| 3,599,364 | 8/1971 | Garcia | 446/354 |
| 3,609,909 | 10/1971 | Gardel et al. | 446/354 |
| 4,563,163 | 1/1986 | Herbstler et al. | 446/354 |
| 5,011,448 | 4/1991 | Asano | 446/293 |
| 5,224,896 | 7/1993 | Terzian | 446/355 |
| 5,238,441 | 8/1993 | Llorens | 446/288 |

FOREIGN PATENT DOCUMENTS

| | | | |
|---|---|---|---|
| 2215223 | 9/1989 | United Kingdom | 446/355 |

*Primary Examiner*—Mickey Yu
*Assistant Examiner*—Laura Fossum
*Attorney, Agent, or Firm*—Morton J. Rosenberg; David I. Klein

[57] ABSTRACT

A transmission mechanism of a motion toy including two reversed rotary members turned by a motor through a transmission gear train via a transmission shaft, each rotary member having a triangular eccentric block and a circular eccentric block, two actuating members alternately reciprocated in horizontal direction by the triangular eccentric blocks of the rotary member to turn two lower legs up and down, two reciprocating members alternately reciprocated by the circular eccentric blocks of the rotary members in vertical direction to turn two arms up and down and to oscillate a head member.

1 Claim, 6 Drawing Sheets

TRANSMISSION MECHANISM OF A MOTION TOY DOLL

BACKGROUND OF THE INVENTION

The present invention relates to motion toy dolls, and more specifically to a transmission mechanism for a motion toy doll which turns the legs and the arms of the toy doll alternately, and simultaneously oscillate the head of the toy doll when operated.

Various motion toy dolls have been disclosed having movable arms, legs, and a head, and have appeared on the market. However, these transmission mechanisms of these motion toy dolls can only move both legs and both arms synchronously, i.e., the legs or the arms are synchronously turned up and down but not alternately turned. The monotonous motions of the legs and the arms cannot attract children's attention for long.

SUMMARY OF THE INVENTION

It is the main object of the present invention to provide a transmission mechanism for motion toy dolls which oscillates the head, and turns the legs and the arms alternately when operated. According to the preferred embodiment of the present invention, the transmission mechanism comprises two reversed rotary members turned by a motor through a transmission gear train via a transmission shaft, each rotary member having a triangular eccentric block and a circular eccentric block, two actuating members alternately reciprocated in horizontal direction by the triangular eccentric blocks of the rotary member to turn two lower legs up and down, two reciprocating members alternately reciprocated by the circular eccentric blocks of the rotary members in vertical direction to turn two arms up and down and to oscillate a head member.

Figure 3:
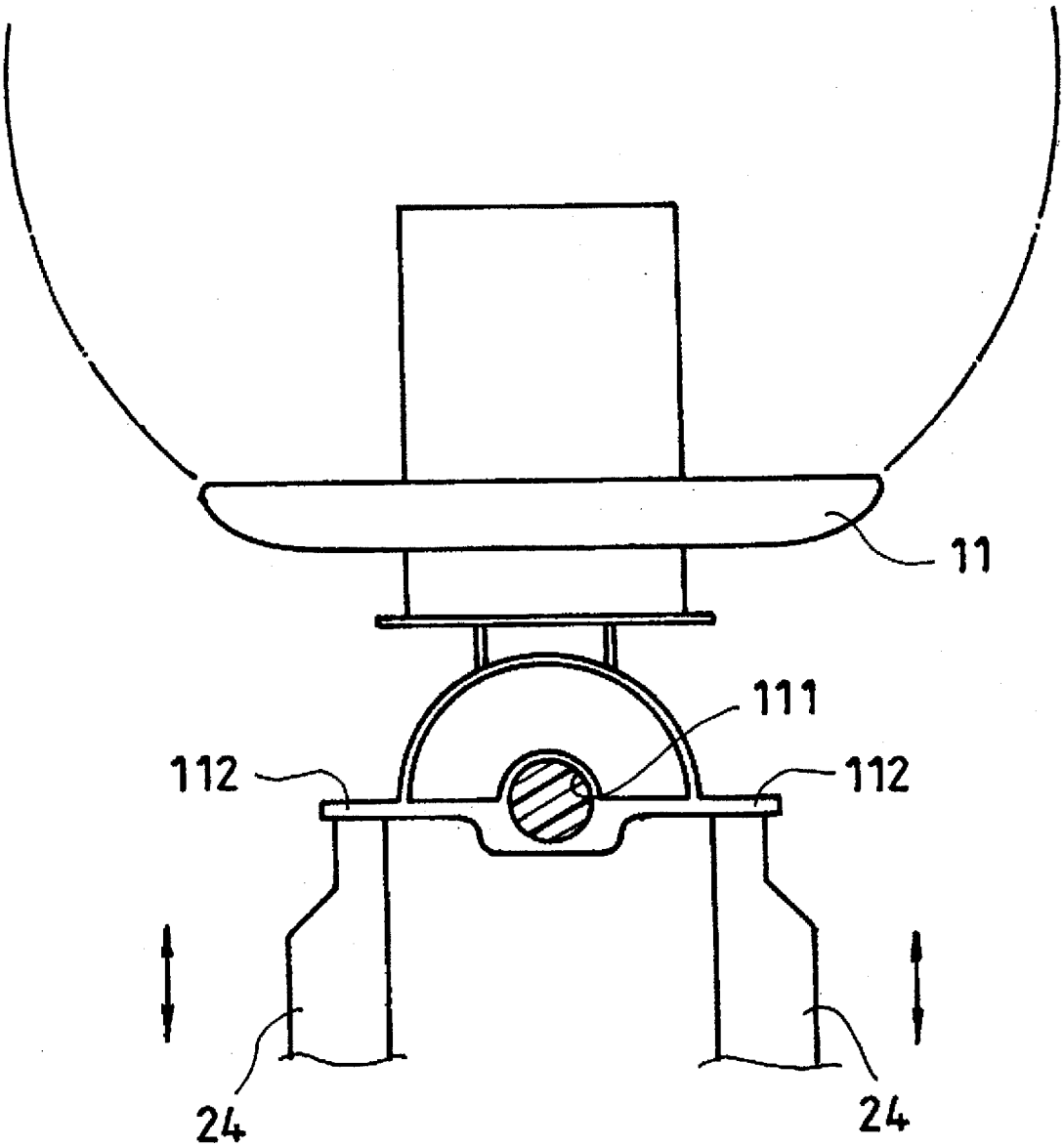

FIGS. from 2-B to 2-F show continuous motions of the arms and the lower legs when the transmission mechanism operated; and, FIG. 3 is an enlarged view of a part of the present invention, showing the reciprocating members reciprocated in vertical direction relative to the head member; and.

Figure 4:
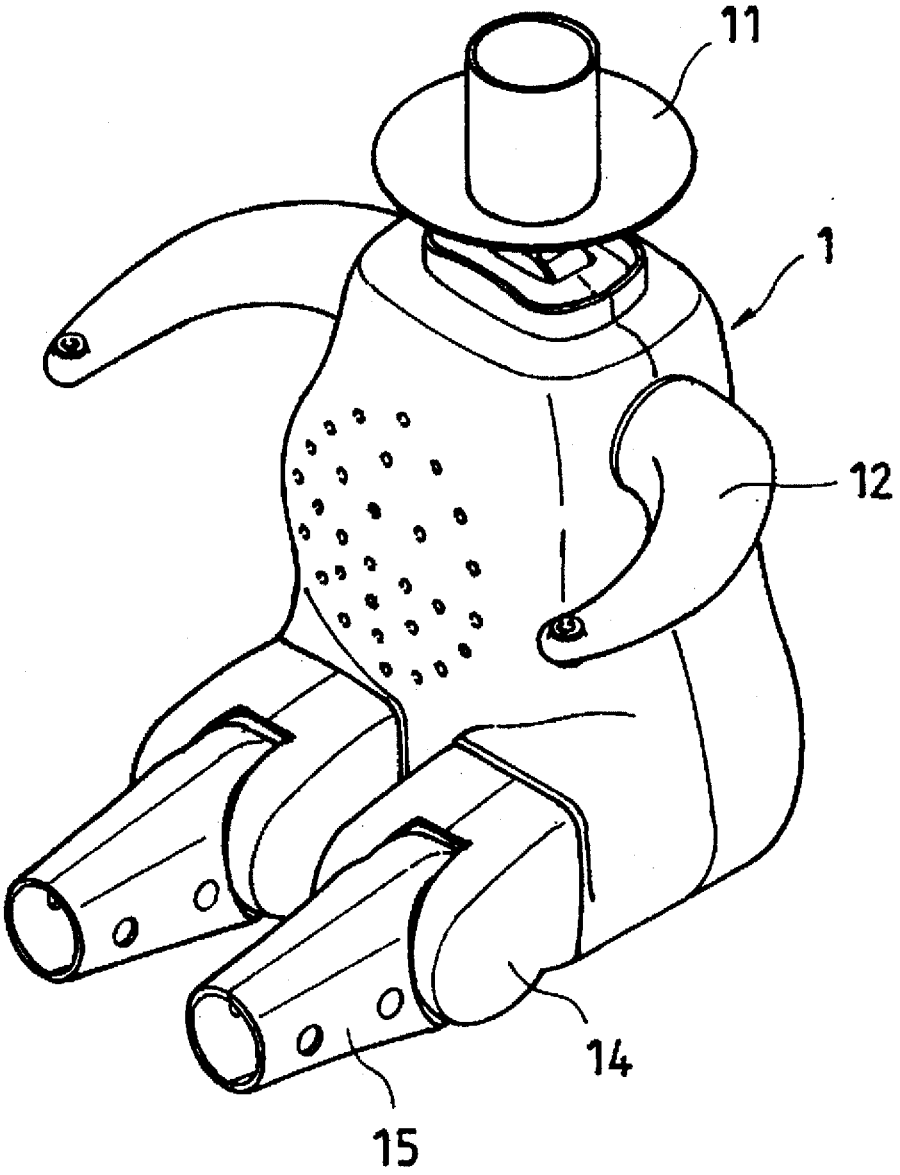

FIG. 4 is an elevational view of the present invention, showing the arms, the upper legs and lower legs, and the head respectively coupled to the body shell.

DETAILED DESCRIPTION OF THE PREFERRED EMBODIMENT

Figure 1:
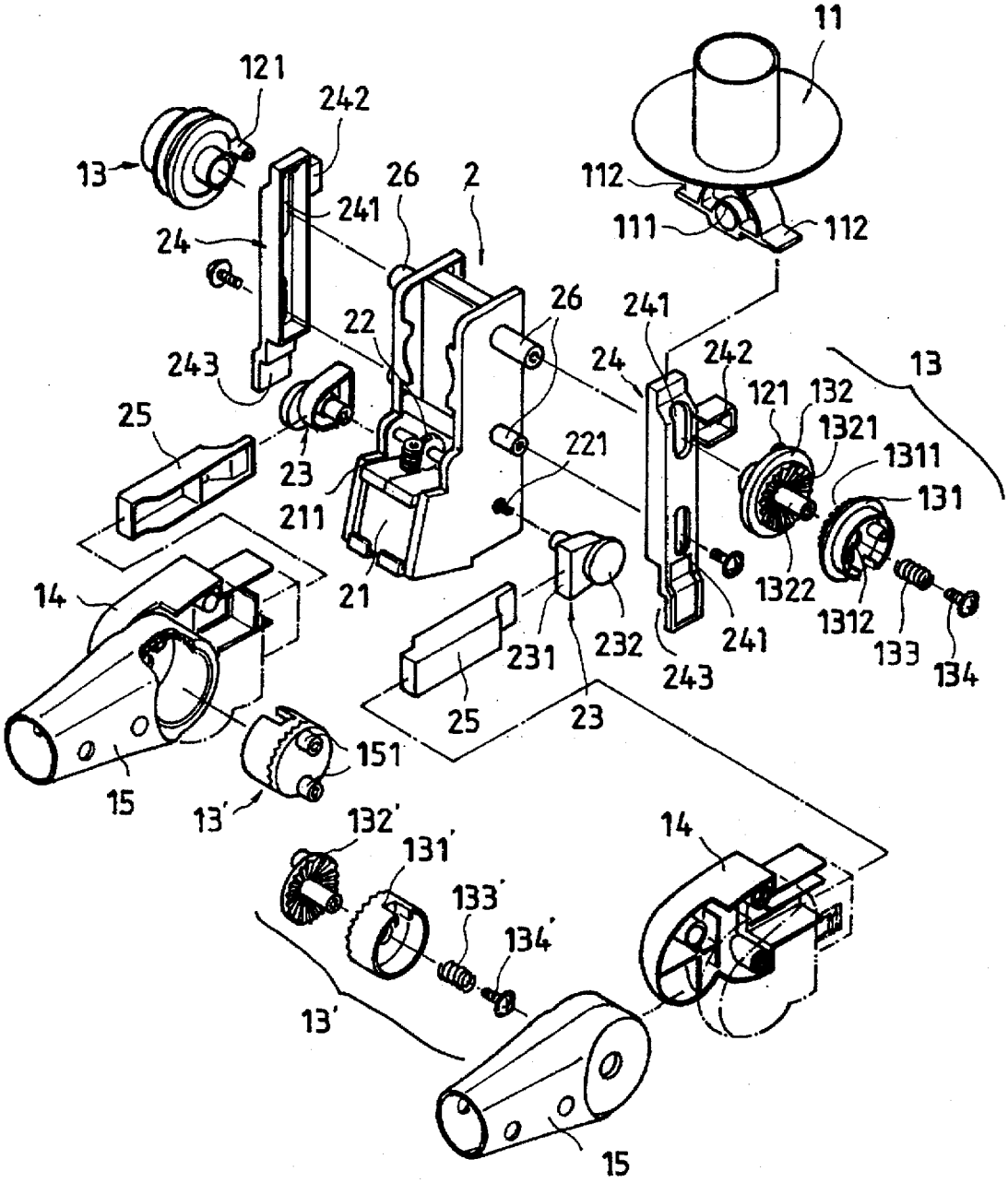
FIG. 1 is an exploded view of a transmission mechanism of according to the present invention (the body shell excluded)
Figure 2A:
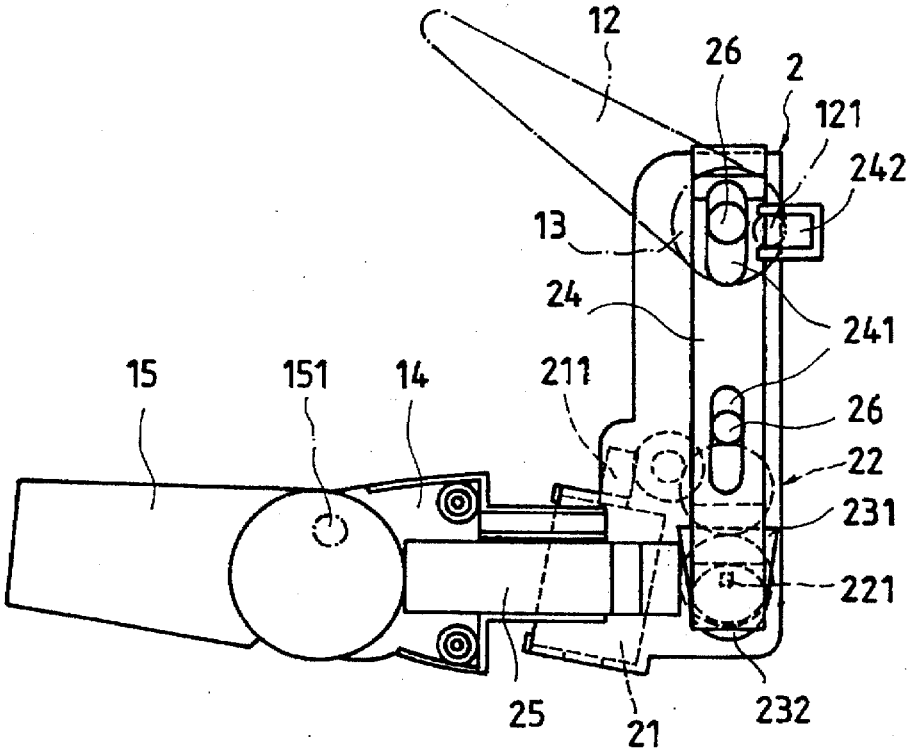
FIG. 2-A is a side view of the transmission mechanism shown in FIG. 1.
Figure 2B:
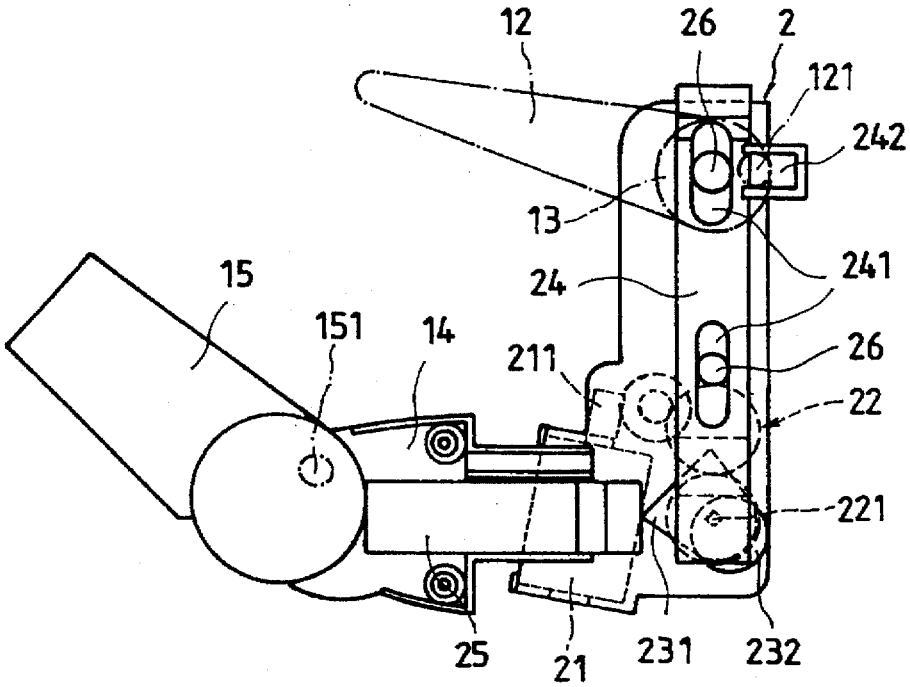
Figure 2C:
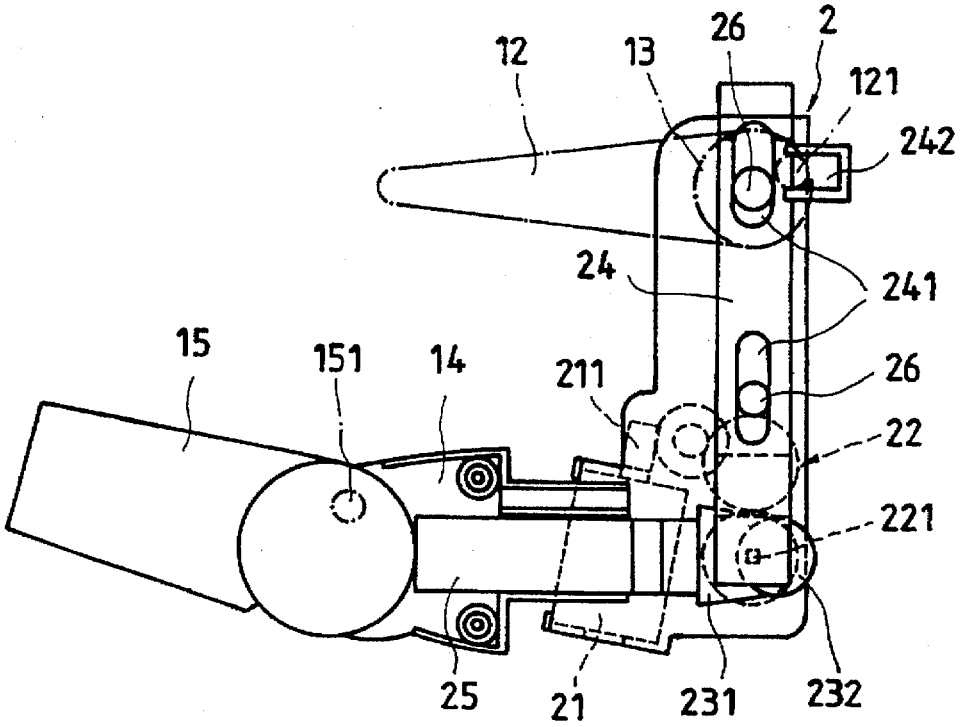
Figure 2D:
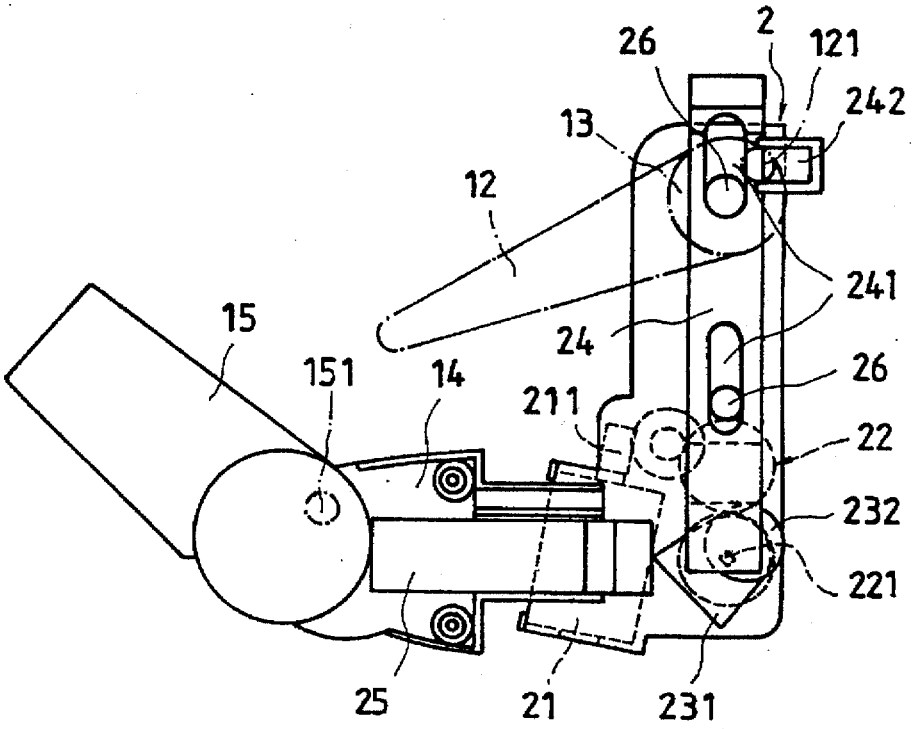
Figure 2E:
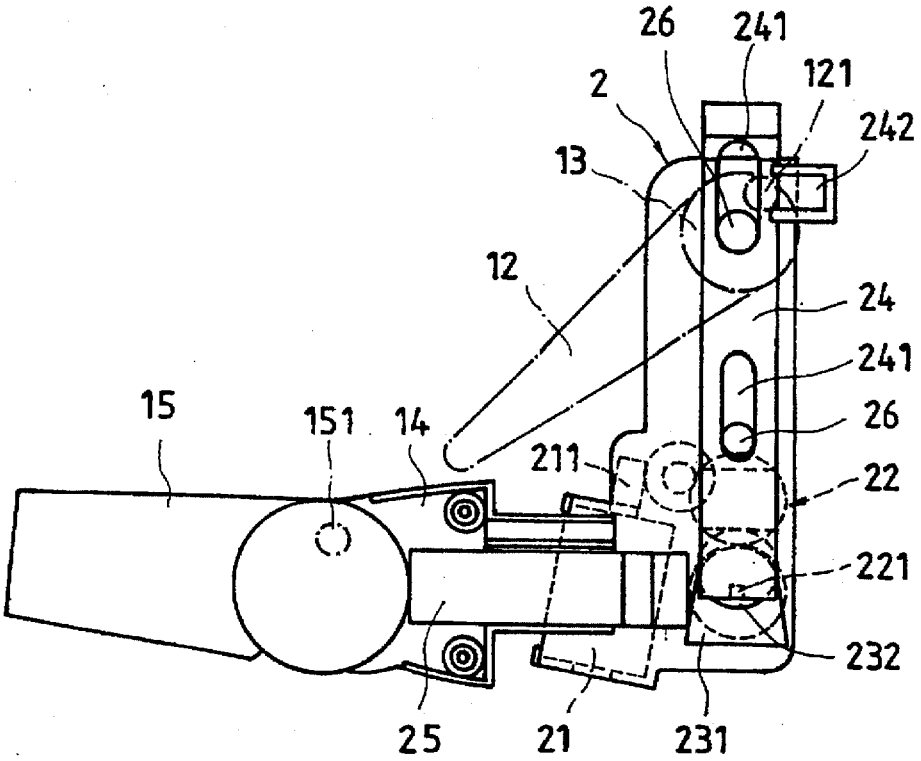
Figure 2F:
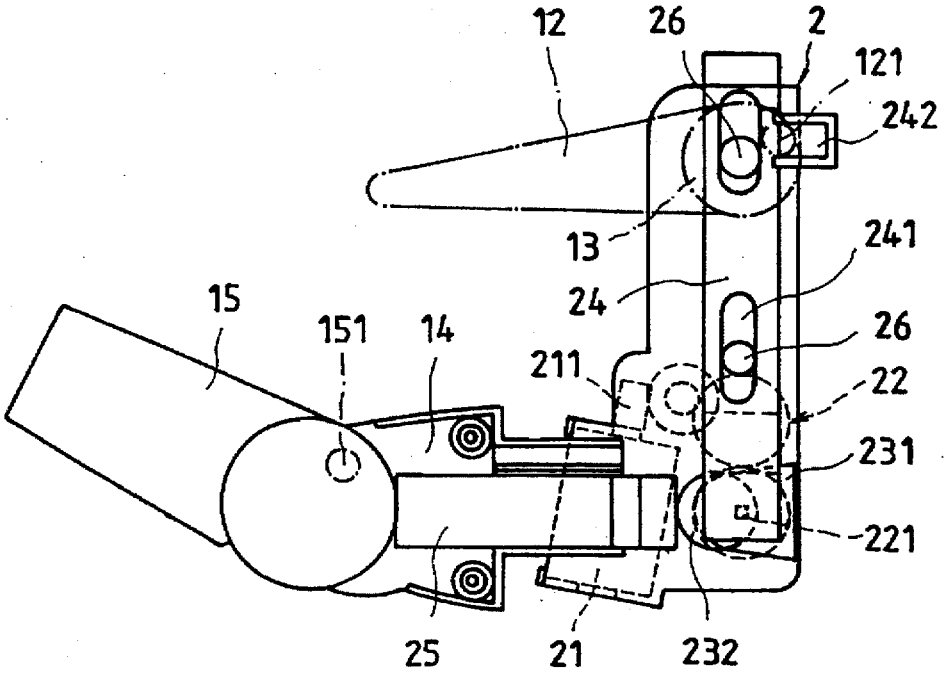

Referring FIGS. 1, 2-1 and 4, a mainframe 2 is mounted inside a body shell 1. The mainframe 2 holds a motor 21 at the bottom. A transmission gear train 22 is mounted inside the mainframe 2, having an input end coupled to the output shaft 211 of the motor 21, and an output end coupled to a transmission shaft 221. The transmission shaft 221 has two opposite ends protruding over two opposite sides of the mainframe 2. Two rotary members 23 are respectively coupled to the two opposite ends of the transmission shaft 221, and turned with it. Each of the rotary members 23 comprises a triangular eccentric block 231, and a circular eccentric block 232. The triangular eccentric block 231 is an isosceles triangle with the vertice between the two sides thereof fixedly connected to one end of the transmission shaft 221. The circular eccentric block 232 is integrally connected to the triangular eccentric block 231 at one side, and turned about an axis through a apart of the periphery. The triangular eccentric block 231 and the circular eccentric block 232 perpendicularly project from the transmission shaft 221 in reversed directions. The two rotary members 23 are arranged in reversed directions, i.e., the rotary members 23 are arranged at 180° angle from each other. Two elongated reciprocating members 24 are coupled to two opposite pairs of vertically spaced horizontal posts 26 at two opposite sides of the mainframe 2 by a slip joint respectively. Each of the elongated reciprocating members 24 comprises two longitudinally spaced elongated coupling holes 241 respectively coupled to the two vertically spaced horizontal posts 26 at one side of the mainframe 2, a hollow projecting coupling portion 242 at the top, and a curved contact portion 243 at the bottom. The curved contact portion 243 fits over and is closely attached to one rotary member 23. A head member 11 is mounted in atop hole (not shown) in the body shell 1 at the top, and adapted for holding a doll's head. The head member 11 has a pivot hole 111 at the bottom pivoted to the mainframe 2 at the top, two horizontal ribs 112 raised from the periphery of the pivot hole 111 at two opposite sides respectively supported on the elongated reciprocating members 24 at the top. Two arms 12 are respectively inserted through two through holes (not shown) at two opposite sides of the body shell 1 near the top, and revolvably coupled to one horizontal post 26 at each side of the mainframe 2 by a respective connector 13. The connector 13 comprises a first wheel 131 fixedly secured to the corresponding arm 12 and having a radially toothed convex face 1311 and a center through hole 1312 through the center of the toothed convex face 1311, a second wheel 132 turned about one horizontal post 26 and having a radially toothed concave face 1321 adapted for engagement with the radially toothed convex face 1311 of the first wheel 131, and a wheel shaft 1322 raised from the center of the radially toothed concave face 1321 and inserted through the center through hole 1312 of the first wheel 131, a headed screw 134 fastened to the wheel shaft 1322 of the second wheel 32 to secure the first wheel 131 in place, and a spring 133 mounted around the headed screw 134 and stopped between the head of the headed screw 134 and the periphery of the center through hole 1312 of the first wheel 131 at one side opposite to the second wheel 132. The spring 133 imparts a pressure to the first wheel 131, causing the radially toothed convex face 1311 of the first wheel 131 to be forced into engagement with the radially toothed concave face 1321 of the second wheel 132. The second wheel 132 further has a projecting rod 121 coupled to the hollow projecting coupling portion 242 of one elongated reciprocating member 24. Two upper legs 14 are respectively mounted in a respective front bottom hole (not shown) in the body shell 1, and respectively coupled to the rotary members 23 by a respective actuating rod 25. Two lower legs 15 are pivotably connected to the upper legs 14 by a respective connector 13'. The actuating rod 25 has one end abutted against the triangular eccentric block 231 of one rotary member 23, and an opposite end inserted through one upper leg 14 (the upper legs 14 have a hollow structure so that the actuating rods 25 can be respectively inserted into the upper legs 14 and horizontally reciprocated) and abutted against the corresponding lower leg 15. The connector 13' is similar to the aforesaid connector 13 in structure and function, comprising a first wheel 131' fixedly secured to the corresponding lower leg 15, a second wheel 132' pivoted to the corresponding upper leg 14, a headed screw 134, and a spring 133' mounted around the screw 134 to force the first wheel 131' into engagement with the second wheel 132'. Furthermore, the connector 13' comprises two rods 151 perpendicularly raised from the second wheel 132'. The rods 151 include one revolvably inserted into a pivot hole inside the corresponding upper leg 14, and the other moved in a limited space inside the corresponding upper leg 14 to guide and limit the turning angle of the respective lower leg 15 relative to the corresponding upper leg 14.

Referring to FIGS. 2—2 to 2-6, and FIG. 3, when the motor 21 is started, the transmission gear train 22 is driven to turn the transmission shaft 221, causing it to turn the rotary members 23. When the rotary members 23 are rotated, the actuating rods 25 are alternately forced by the triangular eccentric blocks 231 of the rotary members 23 to push the lower legs 15 (the actuating rod 25 will be pushed by the two ends of the base of the isosceles triangle of the corresponding triangular eccentric block 231 respectively, therefore the actuating rod 25 is pushed twice when the corresponding triangular eccentric block 231 is rotated through one turn, because the actuating rod 25). When the lower leg 15 is pushed by the corresponding actuating rod 25, it is turned upwards. When the push force is released from the lower leg 15, the lower leg 15 is forced by its gravity to turn downwards to its former position. When the lower leg 15 is turned downwards, the corresponding actuating rod 25 is pushed back to its former position. When the actuating rods 25 are horizontally reciprocated by the triangular eccentric blocks 231 of the rotary members 23, the reciprocating members 24 are alternately reciprocated by the circular eccentric blocks 232 of the rotary members 23 in vertical direction within a limited distance subject to the length of the elongated coupling holes 241. When the reciprocating members 24 are reciprocated vertically, the arms 12 are alternatively turned up and down by the projecting coupling portions 242 of the reciprocating members 24, and the horizontal ribs 112 of the head member 11 are alternately pushed by the reciprocating members 24, causing the head member 11 to oscillate. Because the rotary members 23 are respectively mounted on the two opposite ends of the transmission shaft 221 in reversed directions (180° angle from each other), the actuating rods 25 are alternately reciprocated in horizontal direction, and the reciprocating members 24 are alternately reciprocated in vertical direction, therefore the lower legs 15 are alternately turned by the actuating rods 25, and the arms 12 are alternately turned by the reciprocating members 24.

While only one embodiment of the present invention has been shown and described, it will be understood that various modifications and changes could be made thereunto without departing from the spirit and scope of the invention disclosed.

I claim:

1. A motion toy doll having a transmission mechanism, the doll comprising:

a toy body shell having a top hole, two side through holes at two opposite sides, and two front bottom holes;

a mainframe mounted inside said toy body shell and having a first pair of horizontal posts and a second pair of horizontal posts vertically spaced at two opposite sides;

a motor mounted inside said mainframe;

a transmission shaft;

a transmission gear train mounted inside said mainframe, and coupled between said motor and said transmission shaft;

two rotary members fixedly mounted on two opposite ends of said transmission shaft in reversed directions, each of said rotary members comprising a triangular eccentric block, and a circular eccentric block;

two elongated reciprocating members coupled to the two vertically spaced pairs of horizontal posts of said mainframe at two opposite sides by a respective slip joint, each of said elongated reciprocating members comprising two longitudinally spaced elongated coupling holes respectively coupled to one horizontal post of the first pair of horizontal posts of said mainframe and one horizontal post of the second pair of horizontal posts of said mainframe, a hollow top projecting coupling portion, and a bottom curved contact portion near the bottom, said bottom curved contact portion fitting over and closely attached to one rotary member;

a head member mounted in the top hole of said toy body shell, said head member comprising a pivot hole at a bottom side thereof pivoted to said mainframe, and two horizontal ribs bilaterally raised from the bottom side and respectively supported on said elongated reciprocating members;

two arms respectively turned in said two side through holes at said two opposite sides of said toy body shell;

two first connectors respectively turned about the first pair of horizontal posts of said mainframe and coupled between said arms and said reciprocating members, each of said first connectors comprising a first wheel fixedly secured to the corresponding arm and having a radially toothed convex face and a center through hole through the center of the radially toothed convex face, a second wheel turned about one horizontal post of the first pair of horizontal posts of said mainframe, and having a radially toothed concave face adapted for engagement with the radially toothed convex face of the first wheel of the respective first connector, a wheel shaft raised from the center of the radially toothed concave face and inserted through the center through hole of the first wheel of the respective first connector, and a projecting rod coupled to the hollow top projecting coupling portion of one reciprocating member, a headed screw fastened to the wheel shaft of the second wheel of the respective first connector to secure the first wheel of the respective first connector in place, and a spring mounted around the headed screw of the respective first connector to impart a pressure to the first wheel of the respective first connector toward the second wheel of the respective first connector, two hollow upper legs respectively mounted in the two front bottom holes of said toy body shell;

two lower legs;

two actuating members respectively coupled between said rotary members and said lower legs, each actuating member having one end abutted against the triangular eccentric block of one rotary member and an opposite end inserted into one hollow upper leg and abutted against one end of one lower leg; and, two second connectors respectively coupled between said lower legs and said lower legs for permitting said lower legs to be alternatively turned by said actuating members, each of said second connectors comprising a first wheel fixedly secured to the corresponding lower leg and having a radially toothed convex face and a center through hole through the center of the radially toothed convex face, a second wheel, said second wheel comprising a radially toothed concave face at one side engaged with the radially toothed convex face of the first wheel of the respective second connector, a wheel shaft raised from the center of the radially toothed concave face thereof and inserted through the center through hole of the first wheel of the respective second connector, a pivot at an opposite side turned in a pivot hole in the corresponding upper leg, a headed screw fastened to the wheel shaft of the second wheel of the respective second connector to secure the first wheel of the respective second connector in place, and a spring mounted around the headed screw of the respective second connector to impart a pressure to the first wheel of the respective second connector toward the second wheel of the respective second connector;

wherein when said motor is started, said actuating rods are alternately reciprocated in horizontal direction by the triangular eccentric blocks of said rotary members and said reciprocating members are alternately reciprocated in vertical direction by the circular eccentric blocks of said rotary members, thereby causing said lower legs to be alternately turned up and down by said actuating rods, said arms to be alternately turned up and down by the hollow projecting coupling portions of said reciprocating members, and said head member to be oscillated by said reciprocating members.

* * * * *